United States Patent [19]

Budzich

[11] Patent Number: 4,694,731

[45] Date of Patent: Sep. 22, 1987

[54] LOAD COMPENSATED VALVE

[75] Inventor: Tadeusz Budzich, Moreland Hills, Ohio

[73] Assignee: Caterpillar Inc., Peoria, Ill.

[21] Appl. No.: 944,917

[22] Filed: Dec. 22, 1986

[51] Int. Cl.[4] ..... F15B 13/02

[52] U.S. Cl. ..... 91/421; 91/446; 137/596; 137/596.1; 137/596.13

[58] Field of Search ..... 91/446, 421; 137/596, 137/596.13, 596.2, 596.1

[56] References Cited

U.S. PATENT DOCUMENTS

| | | | |
|---|---|---|---|
| 3,744,517 | 7/1973 | Budzich | 137/596.2 |
| 4,222,409 | 9/1980 | Budzich | 137/596.13 |
| 4,488,474 | 12/1984 | Budzich | 91/446 |

*Primary Examiner*—Gerald A. Michalsky

*Attorney, Agent, or Firm*—J. W. Burrows

[57] ABSTRACT

A load responsive system including individual positive and negative load compensators, for control of positive or negative load and an external logic system for determination of whether the controlled load pressure is positive or negative. The deactivating valve deactivates the positive load compensator, when the negative load pressure exceeds a certain minimum predetermined level, preventing flow of fluid from the system pump to the system actuator controlling a negative load at a pressure higher than a certain predetermined level, and therefore preventing development of excessive pressure in the actuator, while also deactivating the negative load compensator below a certain minimum predetermined negative load pressure level and while the positive load is being controlled by the positive load compensator.

18 Claims, 4 Drawing Figures

LOAD COMPENSATED VALVE

DESCRIPTION

Background of the Invention

This invention relates generally to load responsive fluid control valves and to fluid power systems incorporating such valves, which systems are supplied by a single fixed or variable displacement pump. Such control valves are equipped with an automatic load responsive control and can be used in a multiple load system, in which a plurality of loads is individually controlled under positive and negative load conditions by separate control valves.

In more particular aspects this invention relates to direction and flow control valves capable of controlling simultaneously a number of loads, under both positive and negative load conditions.

In still more particular aspects this invention relates to automatic synchronizing controls for synchronisation of the compensating action of positive and negative compensators, in controlling fluid flow in and out of fluid motors of a cylinder piston rod type.

Closed center load responsive fluid control valves of a fully compensated type are very desirable for a number of reasons. They permit load control with reduced power loss and therefore, increased system efficiency and when controlling one load at a time provide the feature of flow control, irrespective of variation in the magnitude of the load. Such valves are provided with positive and negative load compensating controls, which automatically maintain a constant pressure differential and therefore constant flow characteristics, through the metering control orifices handling the flow in and out of the fluid motor. Such a fluid control valve is shown in FIG. 3 of my U.S. Pat. No. 3,744,517 issued July 10, 1973. However, such fully compensated control valves suffer from one basic disadvantage, when controlling fluid flow to and from an actuator, in the form of a cylinder, which, due to the well known piston rod effect, is characterized by different flow rates between the in and out flows of the cylinder. Depending on the direction of actuation, such cylinders, when controlled by the valve of U.S. Pat. No. 3,744,517, can be subjected either to cavitation, or excessive pressures, due to the energy derived from the pump circuit during control of negative load.

This drawback can be overcome in part by the provisions of the fully compensated proportional valves disclosed in my U.S. Pat. No. 4,222,409, issued Sept. 16, 1980. In this compensated control valve the positive load compensator is deactivated in response to the pressure differential between the negative and positive load pressures and although very effective in the presence of high negative load pressures, it suffers from serious disadvantages in applications, where small negative loads have to be controlled, especially in the zone where those negative load pressures are smaller than the control pressure differential of the negative load compensator.

SUMMARY OF THE INVENTION

It is therefore a principal object of this invention to provide a positive and negative load identification and load pressure signal transmitting system, which permits transmittal of the negative load pressure control signal to the negative load compensator, only after the negative load pressure reaches a certain minimum predetermined level, which ensures proper operation of the negative load compensator.

Another object of this invention is to provide a compensated control, which in the zone of low negative load pressures which are insufficient to operate the negative load compensator, supplements the energy of the negative load from the system pump, permitting proper operation of the negative load compensating controls.

It is a further object of this invention to provide a compensated control, which in control of negative loads which are high enough to permit proper operation of the negative load compensator, ensures that the positive load compensator maintains a constant downstream pressure, thus preventing generation of excessive negative loads, from energy derived from the system pump, during control of negative load.

It is still a further object of this invention to completely deactivate the negative load compensator during control of positive load.

It is a further object of this invention to provide a control, which in the zone of small negative load pressures, uses the positive load compensator as a primary controller, while maintaining the negative load compensator inactive.

It is a still further object of this invention to prevent harmful interaction of the positive and negative load compensators in control of positive and negative loads.

Briefly the foregoing and other additional objects and advantages of this invention are accomplished by providing a novel load responsive fully compensated control of positive and negative loads, which in the zone of low negative load pressures, which are insufficient to operate the negative load compensator, supplements the energy of the negative load from energy derived from the system pump, permitting proper operation of the controls. Above a certain minimum negative load pressure level such a control limits the pressure, upstream of the positive load compensator, to a certain predetermined constant level, preventing generation of excessive negative load pressures in the fluid motor, during control of negative load and which, while controlling small negative load pressures, uses a positive load compensator and completely deactivates the negative load compensator preventing interaction between the positive and negative load compensators.

Additional objects of this invention will become apparent when referring to the preferred embodiments of this invention as shown in the accompanying drawings and described in the following detailed description.

DESCRIPTION OF THE PREFERRED EMBODIMENTS

Figure 1:
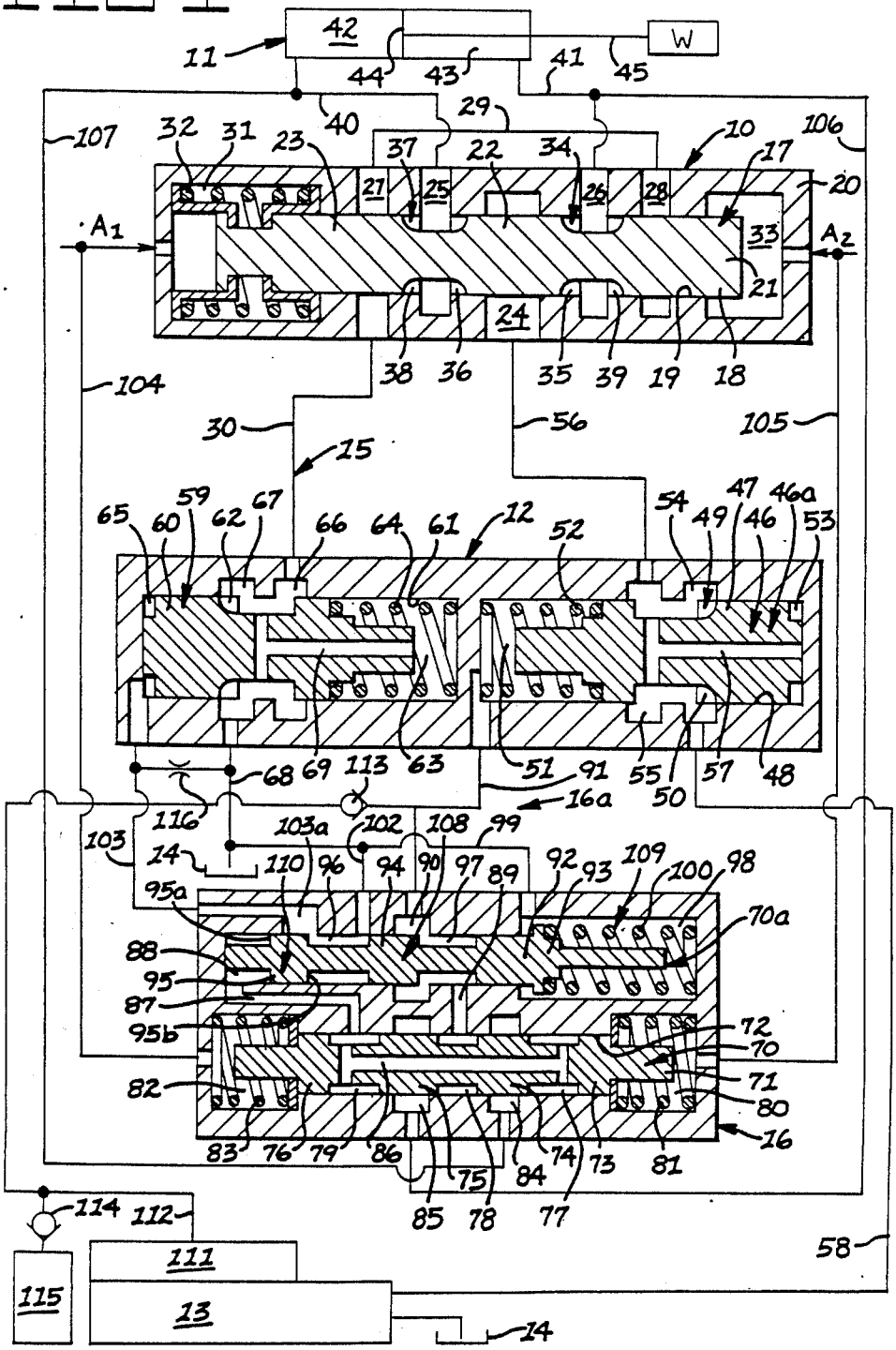
FIG. 1 is a longitudinal sectional view of an embodiment of a single stage compensated direction control valve responding to a hydraulic control signal together with a sectional view of positive and negative load pressure compensators and a sectional view of load pressure signal identifying and transmitting valve, including deactivating controls of individual compensators, with schematically shown system pump, actuator in the form of a cylinder and system reservoir, all connected by schematically shown system fluid conducting lines.

Referring now to FIG. 1, an embodiment of a direction and flow control valve, generally designated as 10, is shown interposed between a fluid motor of a cylinder type, generally designated as 11, and a compensating control assembly, generally designated as 12, supplied with fluid power from a pump 13 and connected to a system reservoir 14, which constitutes part of an exhaust system 15. An external logic module assembly, generally designated as 16, is functionally interconnected to the direction and flow control valve 10, transmits identified load pressure signals to the compensating control assembly 12 and constitutes sensing means 16*a*.

The direction and flow control valve 10 includes first valve means, generally designated as 17, which includes a valve spool 18 of a fourway type, which is axially guided in a bore 19, provided in a housing 20. The valve spool 18 is provided with lands 21, 22 and 23, which in neutral position of the valve spool 18, as shown in FIG. 1, isolate a fluid supply chamber 24, load chambers 25 and 26 and outlet chambers 27 and 28, which are interconnected by line 29 and connected by line 30 to the compensating control 12 and constitute part of the exhaust system 15. The land 23 of the valve spool 18 protrudes into a control chamber 31, subjected to pressure of control signal $A_1$ and engages a centering spring assembly 32, well known in the art. The land 21 of the valve spool 18 protrudes into a control chamber 33, which is subjected to the pressure of a control signal $A_2$. The land 22 is provided with first fluid metering orifice means 34, which include positive or inflow load metering slots 35 and 36. Lands 21 and 23 are provided with second fluid metering orifice means 37, which include negative load or outflow metering slots 38, positioned on land 23 and a negative load or outflow metering slot 39, positioned on land 21.

The load chambers 25 and 26 are connected by lines 40 and 41 with cylindrical spaces 42 and 43, which are separated by a piston 44, which is connected by a piston rod 45 to a load W.

The compensated control assembly 12 includes inlet fluid control means, generally designated as 46, which consists of positive load compensator 46*a* and external logic module assembly 16 and is used in control of positive load compensator spool 47, guided in bore 48 and provided with fluid throttling means 49 in the form of positive load throttling slots 50. One end of the positive load compensator spool 47 protrudes into a control chamber 51 and is subjected to the force of a control spring 52 and the force generated on its cross-sectional area, by the pressure developed in the control chamber 51, while the other end of the positive load compensator spool 47 protrudes into a control chamber 53 and is subjected to a force developed on its cross-sectional area by the pressure in the control chamber 53. Positive load throttling slots 50, located on the positive load compensator spool 47, are operable to throttle fluid flow between an inlet chamber 54 and an outlet chamber 55, which is connected by line 56 with the fluid supply chamber 24, while also being connected through passage 57 with the control chamber 53. The inlet chamber 54 is connected by line 58 to the fluid under pressure supplied from the pump 13.

The compensating control assembly 12 also includes outlet fluid throttling means, generally designated as 59, used in control of negative load, which in turn includes a negative load compensator spool 60, guided in bore 61 and provided with negative load throttling slots 62. One end of the negative load compensator spool 60 protrudes into a control chamber 63 and is subjected to the force of a control spring 64 and the force generated on its cross-sectional area, by the pressure developed in the control chamber 63, while the other end of the negative load compensator spool 60 protrudes into a control chamber 65 and is subjected to a force, developed on its cross-sectional area by the pressure in the control chamber 65. Negative load throttling slots 62, located on the negative load compensator spool 60, are operable to throttle fluid flow between an outlet chamber 66 and an exhaust chamber 67, which is connected by a line 68 with the system reservoir 14. The control chamber 63 is connected to the outlet chamber 66 by passage 69. The external logic module assembly 16 includes external logic valve means, generally designated as 70, and a load pressure signal switching means, generally designated as 70*a*. The external logic valve means 70 is provided with a logic spool 71, guided in a bore 72 and provided with lands 73, 74, 75 and 76, which define annular spaces 77, 78 and 79. The land 73 protrudes into a control chamber 80 and is selectively subjected to the force of a biasing spring 81 and the force developed on its cross-sectional area by the pressure in the control chamber 80. The land 76 protrudes into a control chamber 82 and is selectively subjected to the force of a biasing spring 83 and to the force developed on its cross-sectional area by the pressure in the control chamber 82. The land 74 selectively communicates a control chamber 84 with annular spaces 77 and 78. The land 75 selectively communicates a control chamber 85 with annular spaces 78 and 79. Annular spaces 77 and 79 are interconnected by passage 86 and are connected by passage 87 to a control chamber 88. The annular space 78 is selectively communicable by passage 89 with a control chamber 90, which is connected by line 91 with the control chamber 51.

The load pressure signal switching means 70*a* of the external logic module assembly 16 includes an unloading shuttle 92, which is provided with lands 93, 94 and 95, which define annular spaces 96 and 97. The land 93 protrudes into space 98, which is connected by a line 99 to the system reservoir 14 and is subjected to the biasing force of a spring 100. The land 95 terminates in connecting surfaces 95*a* and 95*b*, protrudes into the control chamber 88 and is subjected to the force developed on its cross-sectional area, due to negative load pressure in the control chamber 88, which force opposes the biasing force of the spring 100. The control chamber 90 is selectively communicable by the land 94 with annular spaces 96 and 97. Annular space 96 is connected by a line 102 and the line 99 to the system reservoir 14. The land 95 selectively communicates through line 103 the control chamber 65 with the control chamber 88, or annular space 96 through control port 103*a*. The control chamber 82 is connected by a line 104 with control chamber 31. The control chamber 80 is connected by a line 105 with the control chamber 33. The control chamber 85 is connected by a line 106 with the load chamber 26 and cylindrical space 43. The control chamber 84 is connected by a line 107 to the load chamber 25 and cylindrical space 42.

First deactivating means 108 of inlet fluid control means 46 is provided in the external logic module assembly 16. Deactivation of the inlet fluid control takes place when the land 94 of the unloading shuttle 92 is displaced from left to right, isolating the control chamber 51 from the annular space 78, passage 89 and annular space 97, while connecting the control chamber 51 through annular space 96 and line 102 with the system reservoir 14.

Means 100 responsive to negative load pressure, above a certain predetermined negative load pressure level is provided by the force differential between the force developed on the cross-sectional area of the land 95 by the negative load pressure in control chamber 88, and the biasing force of the spring 100, which displaces the unloading shuttle 92 from left to right, once this force differential exceeds the preload of the spring 100, in the position as shown in FIG. 1.

Second deactivating means 110 of the outlet fluid throttling means 59, is provided in the external logic module assembly 16. Deactivation of the outlet fluid throttling means 59 takes place when the position of the land 95 connects the control chamber 65 through line 103, control port 103*a* and annular space 96 with the system reservoir 14.

An output control 111 of pump 13 is connected through a line 112 and a check valve 113 with the control chamber 51, while also being connected by a check valve 114 with a load responsive system 115.

A leakage orifice 116 interconnects, for limited leakage flow, the control chamber 65 and line 103 with line 68, connected to the system reservoir 14.

Figure 2:
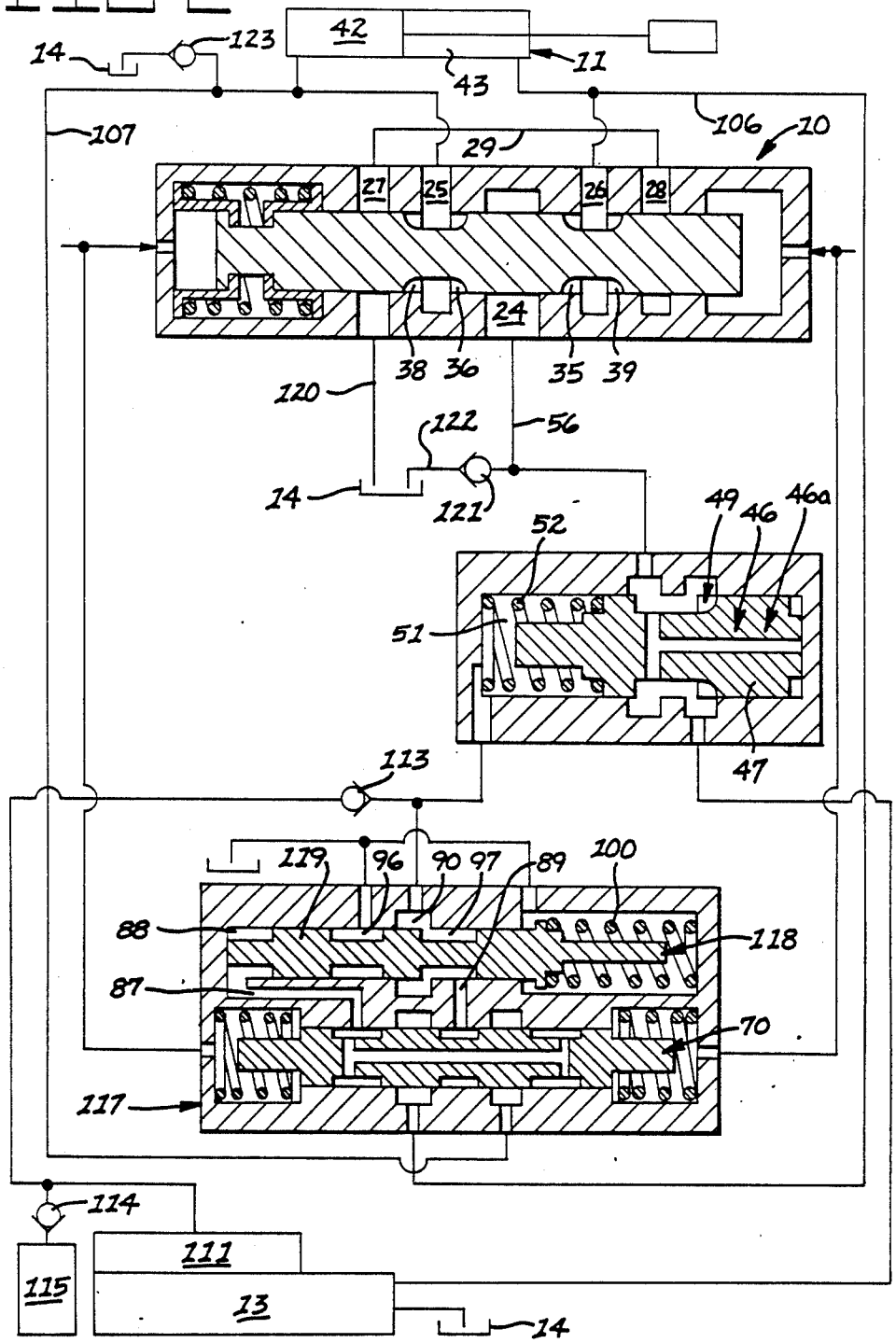
FIG. 2 is a longitudinal sectional view of an embodiment of a single stage compensated direction control valve responding to a hydraulic control signal together with a sectional view of positive load pressure compensator and a sectional view of load pressure signal identifying and transmitting valve, including deactivating controls of the positive load compensator with schematically shown system pump, actuator in the form of a cylinder and system reservoir, all connected by schematically shown system fluid conducting lines.

Referring now to FIG. 2, like components of FIGS. 1 and 2 are designated by like numerals. Basically the control system of FIG. 2 is similar to that of FIG. 1. The one exception being that, although identical positive load compensators 46*a* are interconnected in an identical way with other components of the control system, the control system of FIG. 2 does not include outlet fluid throttling means 59, which is the negative load compensator of FIG. 1. In FIG. 2 the control of negative load is accomplished by direct throttling of fluid flow from the load chambers 25 and 26 through negative load metering slots 38 and 39 to outlet chambers 27 and 28, which are directly connected by line 120 to the system reservoir 14. Since in FIG. 2 negative load compensation is not used, the land 119 of load pressure signal switching means 118, does not connect annular space 96 with negative load compensating circuit of FIG. 1 and therefore the control port 103*a*, of the external logic module assembly 16 of FIG. 1, is not provided in the external logic module assembly 117 of FIG. 2.

As shown in FIG. 2, line 56, leading to the supply chamber 24, can be connected for one way fluid flow by a make-up check valve 121 and a line 122 with system reservoir 14. In a similar way the cylindrical space 42 can be connected with a make-up check valve 123 for one way fluid flow to the system reservoir 14. The make-up check valve 121 could be repositioned to connect space 43 for one way fluid flow to the system reservoir 14.

Figure 3:
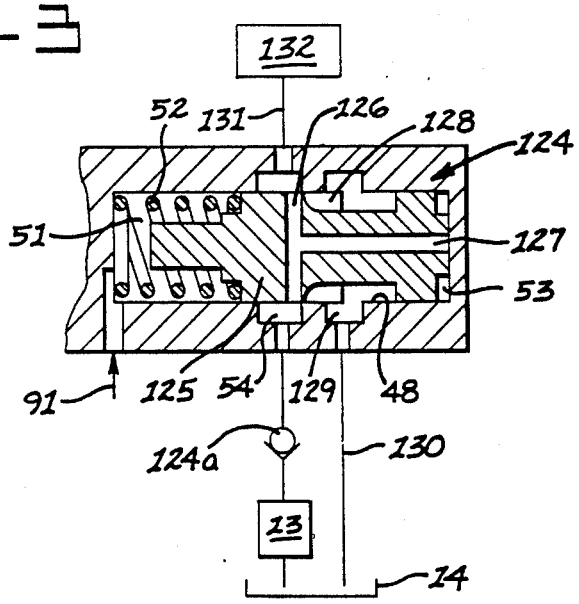
FIG. 3 is a partial sectional view of a positive load compensator of a bypass type with some of the other system components shown schematically.

Referring now to FIG. 3, a partial section of the compensating control assembly, generally designated as 124, is very similar to the compensated control assembly 12 of FIG. 1 and may include an identical outlet fluid throttling means 59 as shown in FIG. 1. The compensating control assembly 124 includes a fluid throttling and bypass member 125 that is similar to the fluid throttling and bypass member 47 and which performs an identical function of controlling the constant pressure differential across the positive or inflow metering slots 35 and 36. The pump 13, through a load check valve 124*a*, is connected to the inlet chamber 54. A throttling and bypass member 125, guided in bore 48 towards position as shown, is biased by the control spring 52, positioned in the control chamber 51, which is connected by line 91 with the external logic module assembly 16, shown in detail in FIG. 1. The inlet chamber 54 is connected by drillings 126 and 127 with the control chamber 53. Throttling and bypass slots 128 are positioned between the inlet chamber 54 and an exhaust chamber 129, which is connected by a line 130 to the system reservoir 14. The inlet chamber 54 is connected by a line 131 to a schematically shown direction control valve assembly 132, which can be identical to the direction and flow control valve assembly 10 of FIGS. 1 and 2.

Figure 4:
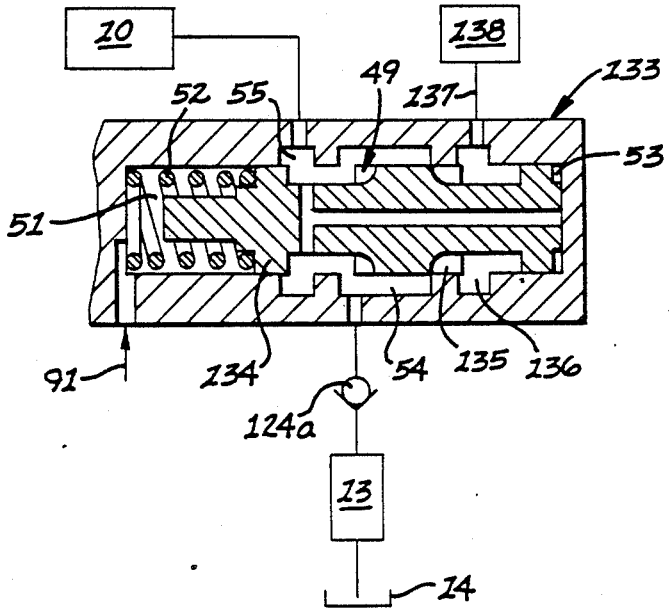
FIG. 4 is a partial sectional view of a positive load compensator of a throttling and bypass type, for use in series type circuits, with series type circuit and other system components shown schematically.

Referring now to FIG. 4, like components of FIGS. 1 and 2 are designated by like numerals. The partial section of a compensating control assembly, generally designated as 133, is very similar to the compensated control assembly 12 of FIG. 1 and may include an identical fluid throttling means 59, as shown in FIG. 1. The compensating control assembly 133 includes a fluid throttling and bypass member 134 that is similar to the fluid throttling and bypass member 47 and which performs an identical function of controlling the constant pressure differential across the positive or inflow metering slots 35 and 36. The throttling and bypass member 134 is provided with fluid throttling means or positive load throttling slots 49 and bypass and throttling slots 135. The bypass and throttling slots 135 are positioned between the inlet chamber 54 and a bypass chamber 136, which is connected by a line 137 to a downstream circuit 138, well known in the art.

Referring now back to FIG. 1, the fluid motor 11 is of a cylinder type and is coupled, through the piston rod 45, to the load W, which may be of an opposing or positive, or an aiding or negative type. The fluid flow to and from the fluid motor 11 is controlled by a direction and flow control valve, generally designated as 10, which has its load chambers 25 and 26 connected by lines 40 and 41 to cylindrical spaces 42 and 43 of the fluid motor 11. In a well known manner, the displacement of the valve spool 18, in either direction from its neutral position, as shown in FIG. 1, will connect the load chambers 25 and 26 with either the fluid supply chamber 24, or outlet chambers 27 and 28, which are connected by lines 58 and 56 to the source of pressure fluid and through lines 29, 30 and 68 to the exhaust system.

The valve spool 18 is biased towards its neutral position as shown in FIG. 1, by the centering spring assembly 32, the preload of which determines the pressure level, necessary to displace the valve spool 18 from its neutral position. Any increase in the pressure level, in control chambers 31 and 33 above that, equivalent to the preload of the centering spring assembly 32, will, in a well known manner, displace the valve spool 18 in either direction, the displacement of the valve spool 18 being directly proportional to the pressure of control pressure signal $A_1$ or $A_2$, or by the pressure differentials between those signals, which are generated by the spool position control system, not shown. During displacement of the valve spool 18, from its neutral position in either direction, the fluid, subjected to the pressure in the supply chamber 24, will be throttled by the inflow or positive load pressure metering slots 35 or 36, on its way to the load chamber 26 or 25 and on the way to the inlet of the fluid motor 11, while the fluid from the outlet of the fluid motor 11 connected with the load chamber 25 or 26, will be throttled, on its way to the outlet chamber 27 or 28, by the outflow or negative load pressure metering slots 38 or 39.

The identification of whether, during control of the load W, the load chamber 25 or 26 is subjected to positive or negative load pressure, is accomplished by external logic valve means 70 of the external logic module assembly, generally designated as 16. The direction of the load W will determine whether the load chamber 25 or 26 is subjected to load pressure. The desired direction of displacement of the load W, in respect to the direction of its force, will establish whether the load W, being controlled at an instant, is of a positive or opposing type, or of a negative or aiding type. Therefore, for any specific direction of the force, developed by the load W, generation of the control pressure signals $A_1$ and $A_2$ will automatically establish the characteristics of the load. The control pressure signals $A_1$ and $A_2$ are transmitted through lines 104 and 105 to the control chambers 82 and 80, causing full displacement, in either direction of the logic spool 71. The preload of the springs 81 and 83 is so selected that full displacement of the logic spool 71 will take place before the valve spool 18, biased towards neutral position of the centering spring assembly 32, is displaced, providing the socalled feature of anticipation. The displacement of the logic spool 71 connects the control chamber 84 or 85 to the positive load passage 89, while also connecting the control chamber 84 or 85 to passage 87, which is part of the negative load pressure transmitting circuit. Since control chambers 84 and 85 are connected by lines 107 and 106 with cylindrical spaces 42 and 43 of the fluid motor 11, the presence of either positive or negative load pressure will be identified by external logic valve means 70 of the external logic module assembly 16, with either positive load pressure, existing in positive load passage 89, or negative load pressure, existing in the passage 87. Therefore, the load pressure is identified as positive or negative by the external logic module assembly 16 and transmitted to the compensating control assembly 12.

The positive load pressure signal, during control of positive load, is transmitted from the positive load passage 89, through annular space 97, control chamber 90 and line 91 to the control chamber 51 of the positive load pressure compensator, generally designated as **46*a*, which, in a well known manner, will throttle, by positive load throttling slots 50, the fluid flowing from the inlet chamber 54, connected to the pump 13, to the outlet chamber 55, which in turn is connected by line 56 with the fluid supply chamber 24, to maintain a relatively constant pressure differential across the inflow or positive load pressure metering slots 36 or 35. In this way, in a well known manner, through the action of the positive load compensator 46*a*, with the constant pressure differential automatically maintained between the supply chamber 24 and the load chamber 25 or 26 the flow through the inflow or positive load metering slots 36 or 35 will be directly proportional to the displacement of the valve spool 18** from its neutral position, irrespective of the magnitude of the positive load W.

The negative load pressure signal, during control of negative load, is transmitted from the passage 87 to the control chamber 88. If the negative load pressure will generate sufficient force, while acting on the cross-sectional area of the land 95, to overcome the preload of spring 100 and move the unloading shuttle 92 from left to right, the control chamber 88 will be connected to the control port **103*a*, line 103 and the control chamber 65. In this way the chamber 65 will be directly connected to negative load pressure. In a well known manner, the outlet fluid throttling means, generally designated as 59, will throttle, by the negative load throttling slots 62, the fluid flow from the outlet chamber 66 to the exhaust chamber 67, to maintain a constant pressure differential between the load chamber 25 or 26 and the outlet chamber 27 or 28. Therefore, the flow of fluid through the outflow or negative load metering slots 38 or 39, during control of negative load, always takes place at a constant pressure differential, making this flow proportional to the displacement of the valve spool 18** from its neutral position, irrespective of the variation in the magnitude of the negative load W.

During control of negative load, as already described, the flow of fluid from the fluid motor 11 is automatically controlled by the outlet fluid throttling means 59 in such a way that it is always proportional to the effective flow areas of the outflow or negative load pressure metering slots 38 or 39. The outflowing fluid from the fluid motor 11, during control of negative load, from one side of the fluid motor must take place, while the required quantity of fluid is supplied from the pump circuit to the other, or inflow side of the fluid motor 11. In a well known manner, the outflow of the fluid motor of a cylinder type is different from the equivalent required inflow, by the volume caused by the displacement of the piston rod 45. Therefore, for any specific displacement of the valve spool 18, flow at different levels will take place through the inflow or positive load pressure metering slots 35 or 36 and through the outflow or negative load pressure metering slots 38 and 39. Since, as described above, the positive and negative load compensated controls of the compensating control assembly 12, automatically maintain constant pressure differentials across the inflow and outflow metering slots of the valve spool 18, trying to maintain the fluid inflow to the fluid motor 11 equal to the fluid outflow from the fluid motor 11 and since, as already described above, with the fluid motor 11 being of a cylinder type, the inflow and outflow are different, the following parasitic effects will occur during control of negative load.

If cylindrical space 42 of the fluid motor 11 is subjected to negative load pressure, the outflow from the fluid motor 11 will be greater than the equivalent required inflow to the cylindrical space 43, and, in a well known manner, due to the positive load compensating action the pressure in cylindrical space 43 will rise to maximum level, in turn proportionally increasing the negative load pressure in cylindrical space 42, using the energy derived from the pump circuit and will result in not only a very inefficient operation, but will also result in the fluid motor 11 being subjected to excessive pressures.

If the cylindrical space 43 of the fluid motor 11 is subjected to negative load pressure, the outflow from the fluid motor 11 will be smaller than the equivalent inflow and, in a well known manner, the pressure in the cylindrical space 42 will drop below atmospheric pressure and the inlet of the fluid motor 11 will be subjected to cavitation.

Load pressure signal switching means 70*a*, located in the external logic module assembly 16, is interposed between the compensated control assembly 12 and the external logic valve means 70. Load pressure signal switching means 70*a* affects the transmittal of the identified load pressure signals to the compensating control assembly 12, in order to synchronize the control action of outlet fluid throttling means 59, which constitute the negative load pressure compensated control of the system, with the control action of the positive load compensator 46*a* in such a way that, irrespective of whether the cylindrical space 42 or 43 of the fluid motor 11 is subjected to negative load pressure, the other cylindrical space of the fluid motor 11 cannot be subjected to either excessive positive load pressures or to the condition of cavitation.

Assume that cylindrical space 42 of the fluid motor 11 is subjected to negative load pressure, which is smaller than that equivalent to the quotient of the biasing force of the spring 100 and the cross-sectional area of land 95. For reasons, which will be described in detail later in the text, the negative load pressure, which would actuate the unload shuttle 92, is selected larger than, or equal to the control pressure differential, as determined by the spring 64, of the outlet fluid throttling means 59. Below this level of negative load pressure the unloading shuttle 92, in the position as shown in FIG. 1, connects directly the control chamber 65 through line 103, connecting surface 95*b*, annular space 96 and line 102 with the system reservoir 14. Therefore, below a certain predetermined negative load pressure level, as dictated by the preload of the spring 100, the control chamber 65 will be subjected to atmospheric pressure, deactivating outlet fluid throttling means 59, with the negative load compensator spool 60 maintained in position as shown in FIG. 1, by the control spring 64. Under those conditions the velocity of the negative load W will be controlled by the positive load compensator 46*a*, which will automatically maintain a constant pressure differential across the orifice, created by displacement of positive load metering slots 35 or 36. Therefore, the pressure in the cylindrical space 43, of the fluid motor 11, will be sufficiently increased, using the energy derived from the system pump 13, to supplement the effect of the small negative load. Therefore, with the control of FIG. 1, in the zone of small negative loads, the velocity of the negative load is controlled by the positive load compensating circuit, with the negative load compensating circuit deactivated by second deactivating means 110. Under those conditions the cylindrical space 42, of the fluid motor 11, cannot be subjected to excessive negative load pressure, cylindrical space 43 cannot be subjected to the cavitation condition and the velocity of the load W is always maintained proportional to the displacement of the valve spool 18.

Assume that cylindrical space 43 is subjected to a large positive load pressure and therefore that the load W is positive. Under those conditions the cylindrical space 42 cannot be subjected to negative load. With very low pressure transmitted by external logic valve means 70 to the control chamber 88, the unloading shuttle 92, biased by the force of the spring 100, remains in the position as shown in FIG. 1, maintaining, in a manner as previously described, the control chamber 65 at atmospheric pressure, deactivating outlet fluid throttling means 59 and therefore directly connecting the outlet chambers 27 and 28 through line 30, the outlet chamber 66 and the exhaust chamber 67 to the system reservoir 14. With the unload shuttle 92, as shown in FIG. 1, the positive load transmitting circuit of external logic valve means 70 is directly connected to the control chamber 51 and the positive load compensator 46*a*, in a well known manner, will automatically maintain a constant pressure differential, as determined by the control spring 52, across any flow orifice through positive load metering slots 35 or 36, caused by displacement of the valve spool 18. With the control pressure differential of outlet fluid throttling means 59 selected higher than the control pressure differential of the positive load compensator 46*a*, when controlling a positive load the negative load compensating circuit is completely deactivated by second deactivating means 110, preventing interaction of the compensators and ensuring high system efficiency during control of positive load.

Assume that during control of a large positive load W, as described above, the direction of the load W is reversed and therefore that the cylindrical space 42 of the fluid motor 11 is now subjected to positive load pressure, while in the absence of negative load the cylindrical space 43 is maintained at minimum pressure. Since external logic valve means 70 automatically diverts the positive load pressure to the positive load compensator 46*a*, irrespective of its direction, and since the unloading shuttle 92 will remain in the same position as shown in FIG. 1, the control over positive load, irrespective of its direction, will be the same, with the negative load compensating circuit deactivated.

Assume that a negative load W is supported by the pressure in the cylindrical space 42 and that this negative load pressure is sufficiently high to ensure proper compensating action of the outlet fluid throttling means 59 and also high enough to displace the unloading shuttle 92 from left to right, against the biasing force of the spring 100. Displacement of the unloading shuttle 92, through displacement of the connecting surface 95*a*, will automatically connect the control chamber 88, subjected to negative load pressure, with control port 103*a* while isolating it by the connecting surface 95*b* from annular space 96 and the system reservoir 14. Since the control port 103*a* is directly connected to the control chamber 65, outlet fluid throttling means 59, in a well known manner, will automatically assume a modulating position, to control the pressure differential across the orifice, created by the displacement of negative load metering slots 38 or 39. The displacement of the unloading shuttle 92 from left to right not only activates in a manner as described above, the negative load compensating circuit, but also, through displacement of the land 94, which is a part of first deactivating means 108, isolates the positive load pressure in passage 89 from the control chamber 90 and connects the control chamber 90, through annular space 96, with the system reservoir, thus connecting the control chamber 51 to atmospheric pressure. Under those conditions the positive load compensator 46*a* will still maintain a constant pressure differential between the pressure in the outlet chamber 55 and the pressure in the control chamber 51, equivalent to the preload of the control spring 52, but, since the control chamber 51 is now maintained at a constant pressure, equal to atmospheric pressure, the pressure in the outlet chamber 55 will be maintained at a constant level, equal to the control pressure differential of the positive load compensator 46*a*, with the positive load compensator 46*a* becoming a form of constant pressure reducing valve. Therefore, the displacement from left to right of the unloading shuttle 92 will not only fully activate the negative load compensating circuit, but will also limit, through the action of the positive load compensating circuit, the maximum pressure from the pump circuit that can be transmitted to cylindrical space 43, during control of negative load, automatically limiting the maximum pressure to which the fluid motor 11 can be subjected, during control of negative load, while also preventing harmful interacting between the positive and negative load compensating controls.

Assume that during control of a large negative load W, as described above, the load W is reversed and therefore that cylindrical space 43, of the fluid motor 11, is now subjected to negative load pressure. The unloading shuttle 92 will remain in its fully displaced position, the external logic valve means 70 will automatically deliver the negative load pressure signal to the control chamber 65, irrespective of the direction of the negative load, the performance of the negative load compensating circuit will remain the same controlling the fluid flow from cylindrical space 43, while the positive load compensator 46*a* will remain in the same modulating position, maintaining the fluid supply chamber 24 at a constant pressure level. The flow metering areas of the positive load pressure metering slots 35 and 36 must be so selected that the maximum flow at constant upstream pressure can be supplied to the cylindrical space 42 without cavitation.

Therefore, the control arrangement of FIG. 1, during control of negative loads, from the fluid motor in the form of a cylinder, protects the fluid motor from excessive pressures, permits control of small negative loads through the positive load compensating circuit, eliminates the harmful interaction between positive and negative load compensators and completely deactivates the negative load compensator, during control of positive load, ensuring high system efficiency.

Since in the control system of FIG. 1 the positive load pressure metering slots 36 and negative load pressure metering slot 38 control the fluid flow into cylindrical space 42 of the fluid motor 11 and since the positive load metering slot 35 and negative load metering slot 39 control the fluid flow to the cylindrical space 43, the effect of the piston rod 45 and the in and out flow differential of the fluid motor 11 can be partially compensated by making metering slots 36 and 38 larger than the metering slots 35 and 39. This approach can only be used with an established flow pattern of the control circuit and may be beneficial to the extent that it reduces the difference in required pressure differentials between positive and negative load compensators.

Since in the absence of A1 and A2 control signals the lands 75 and 74 isolate the negative load pressure transmitting circuit, interrupting the fluid flow into and out of the control chamber 65, a leakage orifice 116 is provided to permit, under all conditions, the negative load compensator spool 60 to assume the position as shown in FIG. 1.

As already described above, in order to displace the valve spool 18 from its neutral position, against the biasing force of the centering spring assembly 32, sufficient net hydraulic force must be applied to the valve spool 18, to displace it against the force developed by the centering spring assembly 32. This net hydraulic force can be obtained either by providing sufficient pressure in the control chamber 33, equivalent to A2 pressure signal, with the control chamber 31 subjected to atmospheric pressure, or by providing sufficient pressure in the control chamber 31, equivalent to the A1 pressure signal, with the control chamber 33 subjected to atmospheric pressure. The more common case, associated with the generation of A1 and A2 pressure signals by an electro-hydraulic servo valve of say, a flapper nozzle type, is where the pressure differential between A1 and A2 pressure signals actuates the valve spool 18. In this case the rate of change of those differentials must be limited to the ability to actuate external logic valve means 70, so that it is shuttled from one end to the other, when the valve spool 18 passes through its neutral position and is subjected to change in the pressure differential, due to the centering spring assembly 32. For a higher frequency response different methods of actuation of external logic valve means 70*a* can be used, as shown for example in my U.S. Pat. No. 4,610,194, issued Sept. 9, 1986.

Referring now back to FIG. 2, the positive load compensator 46*a*, identical to the positive load compensator of the compensating module, generally designated as 12 of FIG. 1, is used in control of positive load W, while the control of negative load is accomplished by the direct throttling action of the negative load metering slots 38 and 39.

The external logic module assembly 117 of FIG. 2 is very similar to the external logic module assembly 16 of FIG. 1, with both of those modules using identical external logic valve means 70. Load pressure signal switching means 118 of FIG. 2 is similar to load pressure signal switching means 70*a* of FIG. 1 and is provided with an identical positive load pressure unloading circuit, as that of FIG. 1, by converting the positive load compensator 46*a* into a constant pressure reducing valve, in the presence of negative load pressure, above a certain minimum predetermined level, as established by the preload in the spring 100.

Since in FIG. 2 the control circuit does not include a negative load compensating control, the unloading feature of the negative load compensator is dispensed with in load pressure signal switching means 118 of FIG. 2. Also since the negative load is not controlled in FIG. 2 by a negative load compensating circuit, the maximum flows out of the fluid motor 11, during control of negative load, are not limited to specific values and may exceed the capacity of the system pump 13. To prevent cavitation, the make-up check valves 121 and 123, well known in the art, are provided.

In the control arrangements of FIGS. 1 and 2, in a manner well known in the art, the maximum positive load system pressure is transmitted through the check valves 113 and 114 to the pump control 111, which automatically will maintain a constant pressure differential between pump discharge pressure and the maximum load pressure transmitted from the load responsive system.

Referring now back to FIG. 3, the throttling and bypass member of the compensating control 124, in a well known manner, maintains a constant pressure differential between the pressure in the inlet chamber 54 and the control chamber 51, which is connected, through line 91, with the positive load identifying circuit of the external logic module 16 of FIG. 1, or 117 of FIG. 2. The level of this constant pressure differential is dictated by the preload in the control spring 52 and is controlled by the throttling action of the throttling and bypass slots 128, diverting the flow from the pump 13, which may be of a constant displacement type, to the exhaust chamber 129 and therefore to the system reservoir 14.

Referring now back to FIG. 4, the throttling and bypass member 134 of the compensating control 133, in a well known manner, maintains a constant pressure differential between the fluid supply chamber 55 and the control chamber 51, which is supplied with fluid at positive load pressure through line 91 from the external logic module 16 of FIG. 1, or 117 of FIG. 2. The control of the pressure differential is obtained either through the throttling action of the positive load throttling slots 49, or through the bypass action of bypass and throttling slots 135. The bypass and throttling action of the bypass and throttling slots 135 permit the excess flow from the pump 13 to be passed to the bypass chamber 136, which is connected in series by line 137 with the series circuit 138. With the positive load control of FIG. 4 the direction and flow control valve 10, connected to the fluid supply chamber 55, has an automatic flow priority over the control valves of series circuit 138, since only the excess flow, over that required by the direction and flow control valve 10, can be passed to the series circuit 138.

The positive load controls of FIGS. 3 and 4 can be integrated in an identical way with negative load compensating controls, can be substituted for the positive load compensators of FIG. 2 and result in identical control characteristics of the control systems of FIGS. 1 and 2, since, through different actions, they still maintain the constant pressure upstream of positive or inflow load pressure metering slots 35 or 36.

Although the preferred embodiments of this invention have been shown and described in detail it is recognized that the invention is not limited to the precise form and structure shown and various modifications and rearrangements as will occur to those skilled in the art upom full comprehension of this invention may be resorted to without departing from the scope of the invention as defined in the claims.

I claim:

1. A load responsive valve assembly supplied with pressure fluid by a pump and operable to control fluid flow to and from a fluid actuator subjected to positive or negative load pressure said load responsive valve assembly comprising sensing means operable to determine whether said fluid actuator is subjected to positive or negative load pressure, first valve means having first and second fluid metering orifice means operably connected to said fluid actuator, inlet fluid control means interposed between said pump and said first fluid metering orifice means selectively operable to maintain a relatively constant pressure differential across said first metering orifice means, while the pressure upstream of said first metering orifice means is permitted to vary with said positive load pressure, and first deactivating means of said inlet fluid control means having means responsive to said negative load pressure above a certain predetermined negative load pressure level whereby said inlet fluid control means can selectively maintain fluid upstream of said first fluid metering orifice means at a relatively constant preselected pressure level when said negative load pressure exceeds said predetermined pressure level.

2. A load responsive valve assembly as set forth in claim 1 wherein said inlet fluid control means includes inlet fluid throttling means.

3. A load responsive valve assembly as set forth in claim 1 wherein said inlet fluid control means includes inlet fluid bypass means interposed between said fluid actuator and reservoir means.

4. A load responsive valve assembly as set forth in claim 1 wherein said inlet fluid control means includes inlet fluid bypass means interposed between said fluid actuator and a series power circuit and throttling means interposed between said pump and said fluid actuator.

5. A load responsive valve assembly as set forth in claim 1 wherein an outlet fluid throttling means is interposed between said second fluid metering orifice means and reservoir means, said outlet fluid throttling means operable to maintain by fluid throttling a relatively constant pressure differential across said second fluid metering orifice means above said certain predetermined negative load pressure level.

6. A load responsive valve assembly as set forth in claim 5 wherein said first deactivating means includes second deactivating means operable to deactivate said outlet fluid throttling means below said predetermined negative load pressure level.

7. A load responsive valve assembly as set forth in claim 5 wherein said sensing means includes external logic valve means.

8. A load responsive valve assembly as set forth in claim 7 wherein said external logic valve means includes said first deactivating means and second deactivating means operable by load pressure signal switching means, said second deactivating means operable to deactivate said outlet fluid throttling means below said predetermined negative load pressure level.

9. A load responsive valve assembly as set forth in claim 1 wherein said sensing means includes external logic valve means.

10. A load responsive valve assembly as set forth in claim 9 wherein said external logic valve means includes said first deactivating means.

11. A load responsive valve assembly supplied with pressure fluid by a pump and operable to control fluid flow to and from a fluid actuator subjected to positive or negative load pressure, said load responsive valve assembly comprising sensing means operable to determine whether said fluid actuator is subjected to positive or negative load pressure, first valve means having first and second fluid metering orifice means operably connected to said fluid actuator, outlet fluid throttling means interposed between said second fluid metering orifice means and reservoir means and operable to maintain by fluid throttling a relatively constant second pressure differential across said second fluid metering orifice means, inlet fluid control means interposed between said pump and said first fluid metering orifice means selectively operable to maintain a relatively constant first pressure differential across said first fluid metering orifice means while the pressure upstream of said first fluid metering orifice means is permitted to vary with said positive load pressure, and first deactivating means of said inlet fluid controls means having means responsive to said negative load pressure above a certain predetermined negative load pressure level whereby said inlet fluid control means can selectively maintain fluid upstream of said first fluid metering orifice means at a relatively constant predetermined pressure level when said negative load pressure exceeds said predetermined pressure level.

12. A load responsive valve assembly as set forth in claim 11 wherein second deactivating means of said outlet fluid throttling means has means operable to deactivate said outlet fluid throttling means below said predetermined negative load pressure level.

13. A load responsive valve assembly as set forth in claim 11 wherein said sensing means includes external logic valve means.

14. A load responsive valve assembly as set forth in claim 13 wherein said external logic valve means includes said first deactivating means.

15. A load responsive valve assembly as set forth in claim 14 wherein said external logic valve means includes load pressure signal switching means, said first deactivating means of said inlet fluid control and second deactivating means of said outlet fluid throttling means operable by said load pressure switching means.

16. A load responsive valve assembly as set forth in claim 11 wherein said inlet fluid control means includes inlet fluid throttling means.

17. A load responsive valve assembly as set forth in claim 11 wherein said inlet fluid control means includes inlet fluid bypass means interposed between said fluid actuator and reservoir means.

18. A load responsive valve assembly as set forth in claim 11 wherein said inlet fluid control means includes inlet fluid bypass means interposed between said fluid actuator and series power circuit and throttling means interposed between said pump and said fluid actuator.

* * * * *